United States Patent [19]

Chaput

[11] 4,204,361

[45] May 27, 1980

[54] BASSINETTE TOY

[76] Inventor: Bertha E. Chaput, 190 London Ave., Las Vegas, Nev. 89109

[21] Appl. No.: 921,999

[22] Filed: Jul. 3, 1978

[51] Int. Cl.[2] ..... A63H 13/00

[52] U.S. Cl. ..... 46/116; 46/11

[58] Field of Search ..... 46/151, 116, 11; D6/14; 150/42, 43, 44, 11, 50

[56] References Cited

U.S. PATENT DOCUMENTS

| | | | |
|---|---|---|---|
| D. 136,335 | 9/1943 | Cutrone | D6/14 |
| 595,685 | 12/1897 | Abraham | 150/11 UX |
| 1,583,284 | 5/1926 | Dykman | 46/151 |
| 1,768,334 | 6/1930 | Stein et al. | 46/151 |
| 2,335,359 | 11/1943 | Rosenberg | 150/50 X |
| 2,628,452 | 2/1953 | Gladstein | 46/116 |
| 3,731,420 | 5/1973 | Crosman | 46/11 X |

*Primary Examiner*—Louis G. Mancene
*Assistant Examiner*—Mickey Yu
*Attorney, Agent, or Firm*—Seiler & Quirk

[57] ABSTRACT

A toy baby bassinette comprises a container having a bottom and walls and an apron extending from the upper periphery of the container walls. The apron can be raised above the container and closed with drawstrings, which also serve as a convenient handle for carrying the bassinette. The bassinette contains a doll housed in a separate open pouch.

5 Claims, 2 Drawing Figures

BASSINETTE TOY

BACKGROUND OF THE INVENTION

Toys for children comprise one of the largest commercial markets in the United States. In many cases, children's toys are merely small replicas of various real items, such as automobiles, animals, and people. It is of course well known for children to have dolls as toys, and to have various household items such as clothing, beds, kitchenware, and the like to play with in connection with the dolls. Accordingly, it is known to have toy baby bassinettes.

It is also known to have certain children's toys which convert or fold up for the purpose of transporting from one place to another. For example, Dykman, U.S. Pat. No. 1,437,467, discloses a doll figure having an upper torso portion having a skirt member attached thereto, which skirt member inverts to envelop the torso portion. The skirt can be closed with a drawstring, which is used to hold the device for carrying. The drawstring method of closing openings in flexible materials is well known; an example of a purse having such a drawstring is shown in McLean, U.S. Pat. No. 2,792,043.

An example of another toy having a convertible carrying case is disclosed in Crosman, U.S. Pat. No. 3,731,420. This patent discloses a toy swing having a doll mounted therein suspended from a vertical base member. The base has two opposing hinged covers which enclose the entire swing when in the closed position, and which serve to stabilize the swing when in an open position parallel to the ground. A handle located at the top of the vertical member is used for carrying.

It is an object of the present invention to provide a toy bassinette for a doll having a decorative apron extending around the bassinette, which apron can be inverted to form a purse-like cover and carrying member. It is a further object of the invention to provide a combination toy bassinette with a doll housed in a separate pouch placed therein, wherein the bassinette has an apron which can be inverted over the base unit by means of a drawstring in the apron to permit transportation of the bassinette by a child, and to preclude the doll and pouch from falling out therefrom.

These and other objects of the invention will be apparent to those skilled in the art from the following description of a specific embodiment thereof.

SUMMARY OF THE INVENTION

A bassinette toy comprises a container having a bottom and side walls and an open top, a flexible decorative apron extending from the upper periphery of the container to entirely surround the container, said apron having at least one drawstring in an outer portion thereof such that when the apron is raised above the container, the container may be substantially closed by operating said drawstring, and a doll removably enclosed within the container.

BRIEF DESCRIPTION OF THE DRAWINGS

The invention is best understood with reference to the drawings, in which.

DETAILED DESCRIPTION OF THE INVENTION

Figure 1:
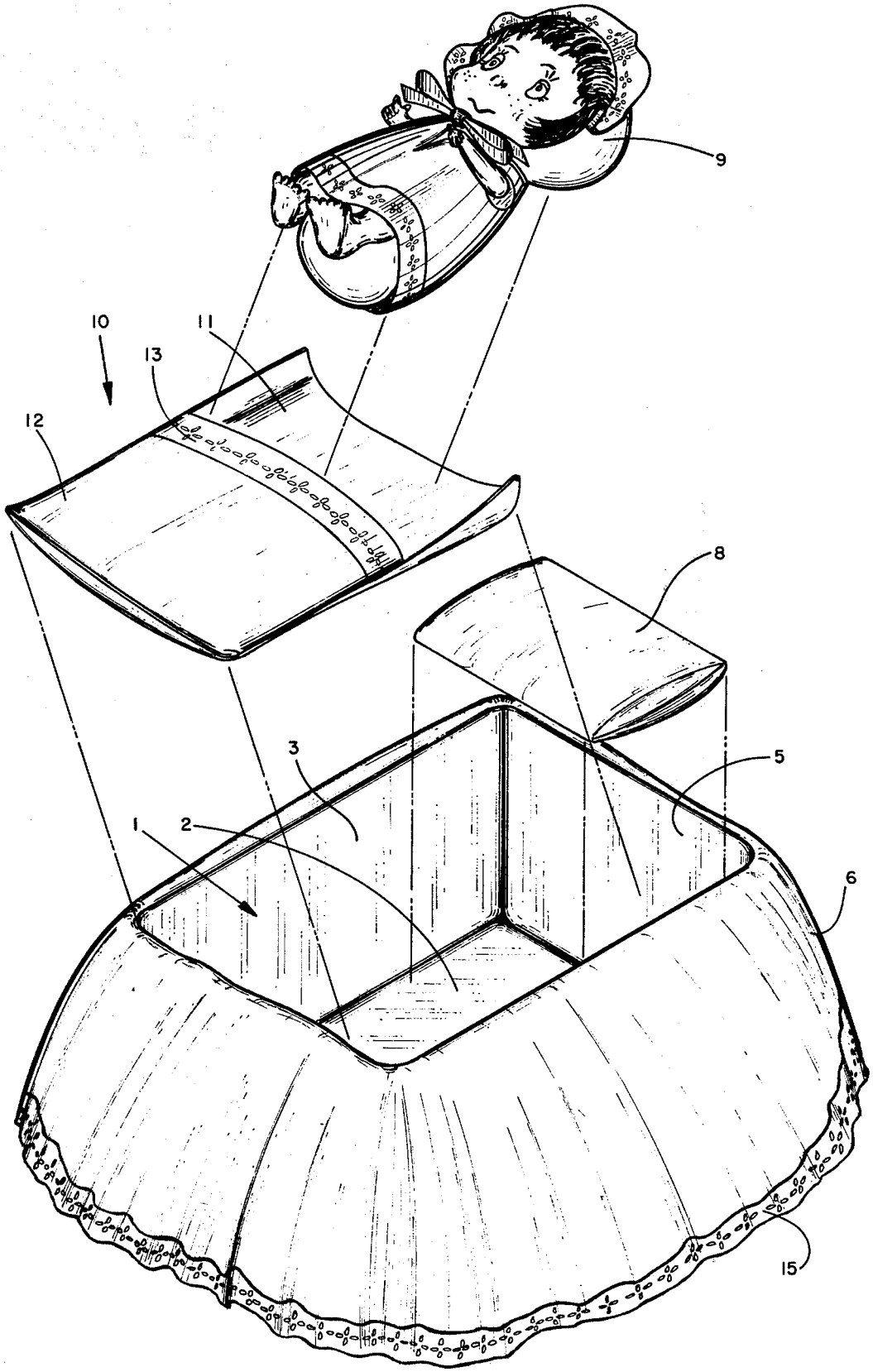
FIG. 1 is a perspective view of the bassinette toy having the top thereof in an open position, with a pillow, pouch, and doll contained therein shown in an exploded view.

Referring to the drawings, container 1 has floor 2, substantially vertical side walls 3 and 4, and substantially vertical end walls 5 and 6. The container is open at the top. The container is fabricated from a flexible plastic material, such as Naugahyde, which is sufficiently thick (about ⅛") and rigid to retain its shape when resting on a rigid surface. The container can also be molded from a rigid material, such as wood, metal, or plastic; if desired, the container could be made in round or oval shape rather than rectangular.

A flexible cloth apron 6 extends outwardly from the upper peripheral edge of the walls. The apron is effectively a cloth ring concentric to the top of the container, with the inner edge of the ring attached to the wall. As shown in FIG. 1, the apron extends downwardly to surround the container walls and to give the toy an attractive, feminine appearance. Preferably, the surface of the apron is decorated with a colorful pattern or lace. The width of the apron is slightly greater than the height of the walls, thereby allowing the apron to flow freely outwardly and yet cover the entirety of the outer wall surface. The bassinette is about 6" long, 4" wide, and 3" high. The apron has a width of about 4½". The unit could of course be made larger or smaller to accomodate different sized dolls. The apron could be fabricated from a knit fabric material, or from a synthetic or plastic sheeting material, so long as it has sufficient flexibility to extend in gathered configuration above the container.

Figure 2:
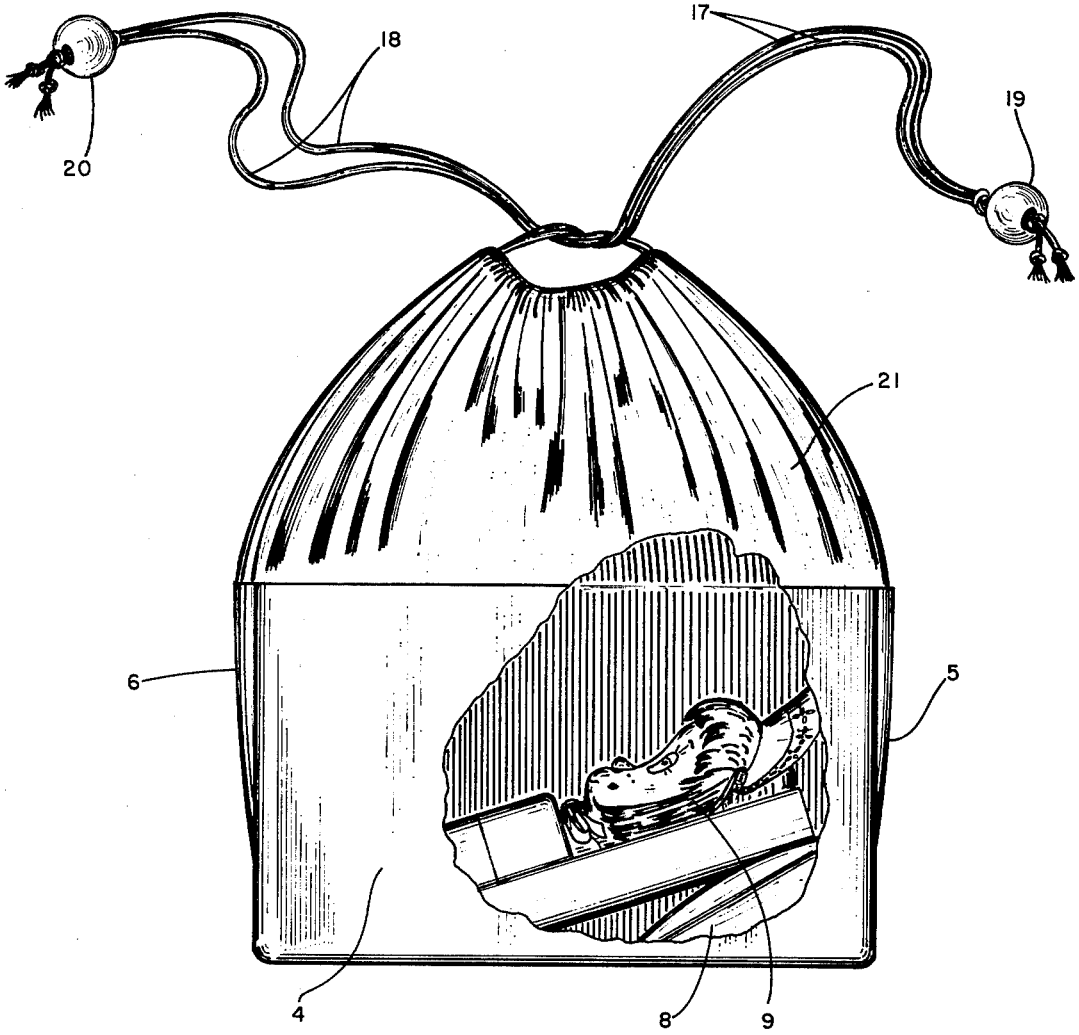
FIG. 2 shows the bassinette having the apron elevated thereabove with the drawstring tightened, with a partial cutaway section showing the doll contained in the pouch in reclining posture in the bassinette.

A small flexible pillow 8 is located at one end of the bottom of the bassinette to support the head of the doll. The doll 9 representing a baby girl fits into a pouch or sack 10 which in turn is placed into the bottom of the bassinette as shown in FIG. 2. The pouch consists of a back panel 11 and a short front panel 12 sewed to the back panel along its sides and edges to form a small chamber into which the doll is slipped feet first. When the doll is inserted in the pouch, the front panel extends approximately to the doll's chin, thereby giving the appearance that the doll is resting between top and bottom sheets. A decorative edge 13 at the top of the short panel gives the appearance that the top sheet is folded back. While the pouch can be made of the same material as the bassinette apron, it is preferable to use at least a double thickness for the back panel thereof to provide sufficient strength for the panel to retain its shape under its own weight as shown in FIG. 1. The back panel approximates the container bottom in size, and tends to curve upwardly at its edges as shown in both drawings to give a somewhat protective effect to the pouch.

An interesting and important feature of the bassinette toy of the invention is the fact that the apron can be inverted over the top of the bassinette, closed by means of drawstrings, and transported without fear of having the doll fall from the bassinette. As shown in FIG. 1, the material at the bottom of the apron is turned up and hemmed, and covered with a decorative lace band 15. The drawstring is formed from two strings 17 and 18 which are threaded through apertures in opposing sides of the apron, around the entire length of hem, and back out through the same aperture.

A pair of cored wooden knobs 19 and 20 are knotted onto each string at its ends to provide convenient grips for pulling the drawstrings. When the apron is raised above the bassinette and the drawstrings pulled in opposite directions, the hem gathers and the opening above the bassinette substantially closes as shown in FIG. 2, and the bassinette may be transported essentially as a purse by using the drawstrings as a handle. In this mode, the doll, pouch, and pillow cannot fall from the bassinette during transportation, and the probability that a child will lose the contents of the bassinette is minimized. The underneath surface 21 of the apron, which is exposed when the bassinette is in the carrying mode, has the same decorative pattern as the outer surface. As an alternative to knobs 19 and 20, decorative tassels may be formed from or attached to the ends of the drawstrings.

The drawstrings are preferably sized such that when the hemmed edge of the apron is completely extended, knobs 19 and 20 are drawn in very close to the apron. Accordingly, when the toy is in use as a bassinette with the apron down, the knobs appear to be part of the decor, and the drawstrings are not visible. If desired, the drawstrings can be fabricated from yarn or ribbon to add to the decorative features of the toy.

The doll and pillow are conventional articles, and no invention is claimed therein. In addition to these articles, many other toy items usable with the doll, e.g. clothing, shoes, baby bottles, marbles, balls, and the like can be carried or stored in the bassinette. Accordingly, when a child has finished playing with the doll and the related articles, the child can place all articles in the bassinette, invert the apron and draw the strings, and carry the toy back to its storage location. Similarly, when the unit is carried from place to place for a visit or vacation, the chances of loss of the contents of the bassinette are significantly lessened.

Many different designs and materials of construction may be used for the bassinette. The walls of the container may be of any structural material sufficient to stand under its own weight. The container may be lined with soft, decorative material to give the bed a more pleasing appearance. The outside and inside surfaces of the apron may be decorated in the same or contrasting colors. Indeed, many modifications will be obvious to one skilled in the art without departing from the spirit and scope of the invention, which should be limited only by the following claims.

I claim:

1. A bassinette toy comprises in combination a container having a bottom and side walls and an open top, a flexible decorative apron extending from the walls near the top and surrounding the container, said apron having a hemmed portion, drawstrings threaded through the hemmed portion of the apron, the apron having a normal downwardly extending position surrounding the walls of the container, and an inverted position useful for carrying the toy with the apron extending upwardly above the top of the container, the drawstrings being drawn and forming a handle for carrying, and a doll adapted to fit in reclining position within the container.

2. The toy of claim 1 wherein the doll depicts a baby.

3. The toy of claim 1 also comprising a decorative pouch.

4. The toy of claim 3 wherein the pouch comprises flexible cloth back and front panels, and an opening between said panels to receive the doll.

5. The toy of claim 4 wherein the back panel is longer than the front panel, such that when the doll is placed in the pouch, a portion of the doll is covered by the front panel, and the entire doll rests on the back panel.

* * * * *